US011988460B2

(12) United States Patent
Botman et al.

(10) Patent No.: US 11,988,460 B2
(45) Date of Patent: May 21, 2024

(54) METHOD OF USING AN INDIRECT HEAT EXCHANGER AND FACILITY FOR PROCESSING LIQUEFIED NATURAL GAS COMPRISING SUCH HEAT EXCHANGER

(71) Applicant: SHELL OIL COMPANY, Houston, TX (US)

(72) Inventors: Maarten Joannes Botman, Hengelo (NL); Jacob Brinkert, Hengelo (NL); Marcel De Vries, Cologne (DE); Roy Niekerk, Rijswijk (NL); Rudolfus Johannes Scholten, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 232 days.

(21) Appl. No.: 16/617,120

(22) PCT Filed: May 28, 2018

(86) PCT No.: PCT/EP2018/063910
§ 371 (c)(1),
(2) Date: Nov. 26, 2019

(87) PCT Pub. No.: WO2018/219855
PCT Pub. Date: Dec. 6, 2018

(65) Prior Publication Data

US 2020/0182552 A1 Jun. 11, 2020

(30) Foreign Application Priority Data

May 30, 2017 (EP) ..... 17173558

(51) Int. Cl.
*F28D 9/00* (2006.01)
*F25J 1/00* (2006.01)
*F25J 1/02* (2006.01)

(52) U.S. Cl.
CPC ..... *F28D 9/0093* (2013.01); *F25J 1/0022* (2013.01); *F25J 1/0235* (2013.01); *F25J 1/0272* (2013.01); *F28D 9/0043* (2013.01)

(58) Field of Classification Search
CPC .... F28D 9/0093; F28D 9/0081; F28D 9/0056; F28D 9/0207; F28D 9/0062;
(Continued)

(56) References Cited

U.S. PATENT DOCUMENTS 3,016,230 A 1/1962 Cederstrom et al.
3,986,549 A * 10/1976 Huggins ..... F28F 3/00 165/145
(Continued)

FOREIGN PATENT DOCUMENTS

CN 2454749 Y 10/2001
CN 102419121 A 4/2012
(Continued)

OTHER PUBLICATIONS

Yunus A. Cengel, Robert H. Turner, Fundamentals of Thermal-Fluid Sciences, Dec. 22, 2011, McGrawHill, pp. 759-760 (Year: 2011).*
(Continued)

*Primary Examiner* — Jianying C Atkisson
*Assistant Examiner* — For K Ling
(74) *Attorney, Agent, or Firm* — SHELL USA, INC.

(57) ABSTRACT

The invention relates to a method of using an indirect heat exchanger comprising a plurality of heat exchange modules arranged in a rectangular grid. Each heat exchange module comprises a plurality of first and second fluid flow channels extending in a first and second direction. The indirect heat exchanger comprises first and second manifolds fluidly connecting the first and second fluid flow channels of one heat exchange module with the first and second fluid flow channels of adjacent heat exchange modules thereby form-
(Continued)

ing one or more first fluid paths. The invention also relates to a facility for processing liquefied natural gas including at least one indirect heat exchanger as described above.

23 Claims, 6 Drawing Sheets

(58) Field of Classification Search
CPC ..... F28F 2260/02; F25J 1/0272; F25J 1/0262; F24F 12/006
See application file for complete search history.

(56) References Cited

U.S. PATENT DOCUMENTS

| | | | | |
|---|---|---|---|---|
| 4,327,803 | A * | 5/1982 | Muellejans | F28D 9/00 165/145 |
| 4,333,522 | A * | 6/1982 | Brune | F23L 15/04 165/145 |
| 4,442,886 | A * | 4/1984 | Dinulescu | F28F 3/083 165/76 |
| 4,890,670 | A * | 1/1990 | Schiessl | F28D 9/0062 228/183 |
| 5,000,253 | A * | 3/1991 | Komarnicki | F28D 9/00 165/903 |
| 5,826,649 | A | 10/1998 | Chapp et al. | |
| 6,357,396 | B1 * | 3/2002 | Stansfield | F28F 3/042 165/166 |
| 8,081,729 | B2 | 12/2011 | Cros | |
| 10,330,391 | B2 | 6/2019 | Tranier et al. | |
| 2002/0153129 | A1 * | 10/2002 | White | F28F 3/025 165/152 |
| 2004/0031592 | A1 * | 2/2004 | Mathias | F16L 41/02 165/104.19 |
| 2007/0158049 | A1 * | 7/2007 | Kim | F24F 12/006 165/50 |
| 2008/0190594 | A1 | 8/2008 | Dahlbeck et al. | |
| 2008/0210415 | A1 * | 9/2008 | Crayssac | F28D 9/0062 165/170 |
| 2010/0015906 | A1 * | 1/2010 | Takahashi | F24F 11/30 454/258 |
| 2010/0175862 | A1 | 7/2010 | Franklin et al. | |
| 2012/0096732 | A1 * | 4/2012 | TeGrotenhuis | F28D 9/0081 165/166 |
| 2013/0125545 | A1 | 5/2013 | Geskes et al. | |
| 2014/0311718 | A1 * | 10/2014 | Nilsson | F28F 9/001 165/133 |
| 2015/0007969 | A1 | 1/2015 | Pal | |
| 2015/0060031 | A1 | 3/2015 | Dietrich et al. | |
| 2016/0108814 | A1 | 4/2016 | Schmitz | |
| 2016/0114439 | A1 | 4/2016 | Pal et al. | |
| 2017/0045257 | A1 * | 2/2017 | Moffitt | F24F 3/147 |

FOREIGN PATENT DOCUMENTS

| | | | | |
|---|---|---|---|---|
| CN | 204830955 | U | 12/2015 | |
| FR | 2955384 | A1 * | 7/2011 | F24F 12/006 |
| FR | 2998953 | A1 | 6/2014 | |
| GB | 2521913 | A | 7/2015 | |
| JP | 2007333353 | A | 12/2007 | |
| KR | 20120027582 | A | 3/2012 | |
| KR | 20140075582 | A | 6/2014 | |
| KR | 20170029450 | A | 3/2017 | |
| WO | 9719310 | A1 | 5/1997 | |
| WO | 2008079593 | A2 | 7/2008 | |
| WO | 2011040859 | A1 | 4/2011 | |
| WO | 2013163398 | A1 | 10/2013 | |

OTHER PUBLICATIONS

International Search Report and Written Opinion received for PCT Patent Application No. PCT/EP2018/063910, mailed on Jul. 23, 2018, 12 pages.

Bejan, "Dendritic Constructal Heat Exchanger With Small-scale Crossflows and Larger-scales Counterflows", International Journal of Heat and Mass Transfer, vol. 45, Issue No. 23, Nov. 1, 2002, pp. 4607-4620, XP055591757.

Office Action Received for Korean Application No. 10-2019-7032924, Mailed on Oct. 14, 2022, 22 Pages(11 Pages of English Translation and 11 Pages of Official).

* cited by examiner

METHOD OF USING AN INDIRECT HEAT EXCHANGER AND FACILITY FOR PROCESSING LIQUEFIED NATURAL GAS COMPRISING SUCH HEAT EXCHANGER

CROSS REFERENCE TO RELATED APPLICATIONS

This is a national stage application of International application No. PCT/EP2018/063910, filed 28 May 2018, which claims priority of European application No. 17173558.2, filed 30 May 2017.

FIELD OF THE INVENTION

The present invention is directed to a method of designing an indirect heat exchanger. The invention also relates to a facility for processing liquefied natural gas, the facility comprising a heat exchanger designed according to said method.

BACKGROUND TO THE INVENTION

Indirect heat exchangers are heat exchangers in which two fluid flows can exchange heat without being in direct contact as the fluids are separated by one or more heat exchange surfaces. The fluid flows may be liquid, vapor, gaseous or multiphase flows. Indirect heat exchangers may be used for different purposes. For instance, indirect heat exchangers can be used in refrigeration cycles to allow a refrigerant to exchange heat with the ambient (e.g. a condenser, cooling down the refrigerant) and to allow the refrigerant to exchange heat with a process stream (cooling down the process stream) in a further indirect heat exchanger. Such refrigerant cycles are for instance used in liquid natural gas plants to cool down and liquefy a natural gas process stream as well as in regasifying plants in which liquid natural gas is heated up to be regasified/vaporized.

Well-known types of indirect heat exchangers currently used in the oil and gas industry are plate heat exchangers and shell and tube heat exchangers. These heat exchangers are typically relatively large. The most compact heat exchangers currently used in the oil and gas industry are printed circuit heat exchangers (PCHE).

With constantly developing manufacturing techniques, such as additive manufacturing, also referred to as 3D printing, the restrictions imposed on the design from a manufacturing point of view become less important.

For instance, WO2008079593 describes a method of using a minimal surface or a minimal skeleton to make a heat exchanger component and describes relatively complicated structures. US20150007969 describes a heat exchanger comprising ribs and slits, which can for example be formed using ultrasonic additive manufacturing (UAM). Reference to additive manufacturing is for instance made in US20160108814, GB2521913A, US20160114439, WO2013163398A1 and CN204830955.

In the prior art, there is a focus on maximizing the surface area of the heat exchanger to maximize the conductive thermal contact between the fluids exchanging heat, while simultaneously avoiding undue flow resistance in order to promote the convective removal of excess heat.

Bejan (*Dendritic constructal heat exchanger with small-scale crossflows and larger-scale counterflows,* International Journal of Heat and Mass Transfer, November 2002) describes to design a two-stream indirect heat exchanger with maximal heat transfer rate per unit volume. Bejan suggests, among others, small scale parallel-plate channels the length of which matches the thermal entrance length of the small stream that flows through this channel, thereby eliminating the longitudinal temperature increase what occurs in a fully developed laminar flow, and it doubles the heat transfer coefficient associated with a fully developed laminar flow. The warm and cold flows in the channels are placed in crossflow. At length scales greater than the elemental, the streams of hot and cold fluid are arranged in counterflow. Each stream bathes the heat exchanger volume as two trees joined canopy to canopy. One tree spreads the stream throughout the volume (like a river delta), while the other tree collects the same stream (like a river basin).

It is noted that the design described by Bejan requires relatively complicated distribution and collecting arrangements to distribute and collect the flows, without explaining the design of thereof. These distribution/collecting arrangements are likely to result in significant pressure losses. Also, the complicated distribution and collecting arrangements are likely to require a lot of material and therefore will not result in a cost-efficient, light-weighted design. In addition, the freedom of designing the overall shape and dimensions of the heat exchanger in accordance with needs is limited.

U.S. Pat. No. 3,986,549 discloses a heat exchanger for exchanging heat between first and second gases such as for preheating the inlet air to a gas heating unit from exhaust air. The exchanger comprises a stack of generally planar serpentine fins each defining side-by-side gas flow passages between the adjacent side portions of the fins and means for mounting the stack of fins with some of these passages extending in one direction for a first gas and others of the passages extending generally transversely to the first gas passages for flow of the second gas in heat exchange relationship with the first gas. Four heat exchanger core units are held in spaced arrangement within a supporting frame and suitably gasketed at the edges by gaskets.

US-2013/125545-A1 discloses a system for utilizing waste heat of an internal combustion engine via the Clausius-Rankine cycle process. In an embodiment, the heat exchanger includes a total of three units. The three units have separate housings and are thereby connected in series hydraulically relative to the working medium. Because of the mixing of the working medium in a mixing duct connecting subsequent units after being conveyed out of a plurality of flow duct parts before being introduced into another plurality of flow duct parts of a subsequent evaporator heat exchanger unit, the working medium can be vaporized substantially completely and uniformly.

Although the heat exchangers described above can be applied advantageously in their respective field of technology, the specific construction of these latter heat exchangers are incompatible with the industrial scale and size required for heat exchangers for the oil and gas industry. In other words, when scaled up to the industrial size required for, for instance, the liquefaction of natural gas, the above heat exchangers are unable to compete with the conventional heat exchangers used for industrial scale cooling. As such, the heat exchangers of US-2013/125545-A1 and U.S. Pat. No. 3,986,549 are unsuitable for scale up and application in a facility for processing liquefied natural gas.

SUMMARY OF THE INVENTION

It is an aim to provide a heat exchanger which overcomes at least one or more of the above disadvantages, such as providing a heat exchanger with an improved architecture, with an improved balance between maximizing heat transfer per unit volume and minimizing pressure drop.

In one aspect, the present invention is directed to a method of using an indirect heat exchanger (1), the indirect heat exchanger comprising:

a first inlet for receiving a first fluid flow, a first outlet for discharging the first fluid flow, a second inlet for receiving a second fluid flow, a second outlet for discharging the second fluid flow, a plurality of heat exchange modules (10) arranged in a rectangular grid, the grid having a first direction, a second direction and a third direction, the heat exchange modules each comprising a first module face and a second module face being opposite to each other in the first direction, the heat exchange modules each comprising a third module face and a fourth module face being opposite to each other in the second direction, wherein the heat exchange modules (10) each comprise a plurality of first fluid flow channels (11) extending between the first module face and the second module face for accommodating the first fluid flow and a plurality of second fluid flow channels (21) extending between the third module face and the fourth module face for accommodating the second fluid flow, first manifolds (12) fluidly connecting the plurality of first fluid flow channels (11) of one of the heat exchange modules with the plurality of first fluid flow channels (11) of an adjacent heat exchange module (10) thereby forming one or more first fluid paths connecting the first inlet with the first outlet and running through two or more heat exchange modules (10), and second manifolds (22) fluidly connecting the plurality of second fluid flow channels (21) of one of the heat exchange modules with the plurality of second fluid flow channels (21) of an adjacent heat exchange module (10) thereby forming one or more second fluid paths connecting the second inlet with the second outlet and running through two or more heat exchange modules (10).

In use, the first manifolds collect the first fluid from a heat exchange module, i.e. from all the first fluid flow channels of this heat exchange module, conveys at least part of the first fluid to a different, adjacent heat exchange module and feeds the first fluid to the first fluid flow channels of this adjacent heat exchange module.

The first, second and third directions are perpendicular with respect to each other. The heat exchange modules are arranged in a rectangular grid. The rectangular grid preferably comprises $N_x$ heat exchange modules (10) in the first direction, $N_y$ heat exchange modules (10) in the second direction and $N_z$ heat exchange modules (10) in the third direction. The indirect heat exchanger thus comprises N heat exchange modules, $N=N_x*N_y*N_z$. So, each heat exchange module can be identified by a coordinate $n_x$, $n_y$, $n_z$, with $n_x=1, \ldots, N_x$, $n_y=1, \ldots, N_y$ and $n_z=1, \ldots N_z$ (n and N being integers). According to an embodiment, N>1. According to a further embodiment, $N_x>1$ and $N_y>1$ and $N_z>1$ and N>8.

In order to limit the overall size of the indirect heat exchanger, the rectangular grid in which the plurality of heat exchange modules (10) are arranged is preferably made cubicle (substantially equal lengths in all three directions), as this will limit the size of the distribution and collecting headers and thereby the overall size and weight of the indirect heat exchanger and thus the costs thereof.

The heat exchange modules are preferably shaped as a parallelepiped, for instance having a rectangular or box shape, in which the first and second fluid flows are in cross-flow. This allows compact stacking of the heat exchange modules in a grid configuration and facilitates analytical calculations and simulations, using validated correlations for heat transfer and pressure drop. This in turn enables the creation of a parametrized model which describes all performance indicators as combinations of geometrical and process parameters. By implementing the parametrized model in suitable software, the design can be optimized for any set of performance indicators like mass and volume.

By ensuring that all first fluid flow channels (11) substantially extend in the first direction, i.e. extend between the first and second module faces and all second fluid flow channels (21) substantially extend in the second direction, i.e. extend between the third and fourth module faces in each heat exchange module (10) a relatively simple lay-out of the first and second manifold and relatively simple distribution and collecting headers become possible. The lay-out is such that the first fluid flows of the different heat exchange modules are aligned and the second fluid flows of the different heat exchange modules are aligned. The distribution headers may also be referred to as a distribution or feeding manifolds/arrangements. The collection headers may also be referred to as a collecting manifolds/arrangements.

According to an embodiment, the first fluid flow channels are straight and are directed in the first direction and/or the second fluid flow channels are straight and are directed in the second direction.

In the here suggested set-up (part of) a first face of the rectangular grid can be dedicated to receiving the first fluid, (part of) a second face of the rectangular grid can be dedicated to discharging the first fluid, (part of) a third face of the rectangular grid to receiving the second fluid and (part of) a fourth face of the rectangular grid to discharging the second fluid. As faces of the grid are only dedicated to a single fluid and either inflow or outflow, no complicated distribution and collecting headers and are needed.

A first distribution header may be provided to distribute the first fluid flow over (part of) the first face of the rectangular grid. A first header arrangement may be provided to collect the first fluid flow from (part of) the second face of the rectangular grid.

A second distribution header may be provided to distribute the second fluid flow over (part of) the third face of the rectangular grid. A second collecting header may be provided to collect the second fluid flow from (part of) the fourth face of the rectangular grid.

In the set-up suggested by Bejan, the first fluid flow channels and the second fluid flow channels are not consequently orientated in one direction, with the purpose of allowing heat exchange to take place between the first and second fluids in the first and second manifolds. Consequently, in the set-up suggested by Bejan, faces of the grid are dedicated to more than one fluid, requiring complicated distribution and collecting arrangements to distribute and collect the different flows.

In addition, it is noted that according to Bejan the amount of heat exchange (duty) that can take place between the first and second fluids in the first and second manifolds is very limited. Depending on the temperature cross rate, this may be in the order of up to 50% of the required overall duty of the indirect heat exchanger. The duty of the first and second manifolds is proportional to the area, the heat transfer coefficient and the temperature difference. The heat transfer coefficient depends on the material properties and the velocity of the fluids exchanging heat.

According to embodiments provided here, the cross-sectional sizes of the first and second manifolds are preferably selected relatively high, to ensure even distribution of fluid among all fluid flow channels of the heat exchange module to which the fluid is to be distributed. Additionally, the aspect ratio of the manifold is preferably relatively low, to minimize viscous losses.

In the currently proposed indirect heat exchanger, no heat exchange is supposed to take place in the manifolds as heat exchange will primarily take place between the first and second fluid flow channels. This provides more flexibility in designing the heat exchanger as it allows to place blocks in series and/or parallel thereby providing a more optimal design of the indirect heat exchanger in terms of pressure drop, plot space and total volume.

Additionally, the currently proposed indirect heat exchanger allows for more freedom to design the overall shape of the indirect heat exchanger, for instance allows to reduce the plot space, as it provides more freedom in how to fluidly connect the heat exchange modules. The currently proposed indirect heat exchanger allows for serial connection of the heat exchange modules, as is described in more detail below with reference to FIGS. 2*a,* 2*c* and 2*d.*

Furthermore, Bejan proposed to allow the first and second fluid to exchange heat in the distribution and collecting arrangements (header). However, this was at the cost of a significant pressure loss in the relatively complicated distribution and collecting arrangements. In the currently proposed indirect heat exchanger this is not provided, as heat exchange between the first and second fluids takes place in the heat exchange modules (i.e. between the first and second fluid flow channels) and the distribution and collecting arrangements only serve for distribution and collection of the flows.

The architecture of the currently proposed indirect heat exchanger is formed by a number of optimized heat exchange modules which are designed and connected in a space efficient way. The advantage of the use of relatively small and relatively many heat exchange modules is that the efficiency is higher, because a large part of the flow is undeveloped (the heat transfer to pressure drop ratio is higher before the thermal entrance length is reached). The architecture, moreover, allows for connecting heat exchange modules in parallel or in series to match the required duty specification and pressure drop limitations.

The first fluid flow may be a hot medium (e.g. coolant/refrigerant) or a cold medium, for instance an ambient water or air stream. The second fluid flow may be a cold medium or a hot medium (different from the first fluid), e.g. a process stream to be cooled or warmed by the first fluid flow, or vice versa. The terms hot and cold medium are used in relation to each other, meaning that the hot medium is warmer than the cold medium upon entry of the first and second fluids into the indirect heat exchanger. So, the overall heat exchange between the first and second fluid flow is a heat flow from the warm to the cold medium.

The method as described above may comprise the step of using the indirect heat exchanger for the processing of liquefied natural gas.

The method as described above may comprise the step of using the indirect heat exchanger for liquefying natural gas.

According to a further aspect there is provided a method of designing an indirect heat exchanger as described above, wherein the method of designing comprises:

determining design operating parameters of the indirect heat exchanger, the design operating parameters comprising one or more of: flow rate of the first fluid flow, inlet temperature of the first fluid flow, outlet temperature of the first fluid flow, inlet pressure of the first fluid flow, outlet pressure of the first fluid flow, physical properties, such as mass density, viscosity, specific heat capacity and thermal conductivity) of the first fluid, flow rate of the second fluid flow, inlet temperature of the second fluid flow, outlet temperature of the second fluid flow, inlet pressure of the second fluid flow, outlet pressure of the second fluid flow, duty of the indirect heat exchanger, physical properties, such as mass density, viscosity, specific heat capacity and thermal conductivity of the second fluid, wherein the method further comprises, based on the design operating parameters, i) determining the amount of heat exchange modules to be comprised in the first and second fluid paths, ii) determining the amount of first and second fluid flow channels (11, 21) per heat exchange module, as well as the cross-sectional dimensions of the first and second fluid flow channels (11, 21), iii) determining the lengths of the first and second fluid flow channels (11, 21), iv) determining the dimensions of the first and second manifolds, v) determining a lay-out of the rectangular grid, vi) determining the dimensions of a first distribution header (101), a first collection header (102), a second distribution header (103) and a second collection header (104).

For action (i) a minimal number of heat exchange modules to be comprised in series in the one or more parallel first and second fluid paths number is determined to prevent or minimize temperature crosses. The minimum number $N_{min}$ may be computed as follows:

$$N_{min}=|T_{in,1}-T_{in,2}|/(0.5*((|T_{in,1}-T_{out,2}|)+(|T_{out,1}-T_{in,2}|)))$$

wherein 1 refers to the hot fluid and 2 refers to the cold fluid, $T_{in}$ means temperature at the inlet and $T_{out}$ means temperature at the outlet.

The amount of heat exchange modules to be comprised in the first and second fluid paths is determined by balancing overall temperature difference against acceptable pressure drop, with the restriction that that the amount may not be smaller than $N_{min}$.

For action (ii) the amount of first and second fluid flow channels (11, 21) per heat exchange module, as well as the length and cross-sectional dimensions of the first and second fluid flow channels (11, 21) may be determined to ensure that the first and/or second fluid flows, within the respective fluid flow channels remains laminar, as laminar flows provide a relatively good heat transfer to pressure drop ratio. Alternatively, the amount of first and second fluid flow channels (11, 21) per heat exchange module, as well as the length and cross-sectional dimensions of the first and second fluid flow channels (11, 21) may be determined to obtain a relatively compact design, allowing for a higher pressure drop. It is noted that different considerations may be taken into account or may be weighed differently for the first fluid flow channels than for the second fluid flow channels.

For action (iii), for laminar flow conditions, the respective lengths of the first and second fluid flow channels (11, 21) may be selected to be equal or smaller than the thermal entrance length of the first and second fluid respectively. The respective lengths of the first and second fluid flow channels (11, 21) are may be selected such that the first and second fluid flows in the respective first and second fluid flow channels are undeveloped over the entire length of the fluid flow channel or at least over most of the length of the fluid flow channel, preferably at least over 90%, 75% or 50% of the length of the fluid flow channel.

For action (iv) the dimensions of the first and second manifolds are preferably determined to ensure that a homogeneous fluid distribution is achieved before the fluid flow enters the subsequent heat exchange module. Typically, the length of the first and second manifolds are selected to be at most 75% or 50% of the length of the respective thermal entrance length or the respective fluid flow channel.

This provides the additional advantage that simulation of the indirect heat exchanger is simplified, as all heat exchange modules receive a similar homogeneous fluid distribution, having a substantially flat temperature profile in a direction perpendicular to the flow direction.

In action (v) the lay-out of the rectangular grid is determined, which includes determining the amount of heat exchange modules in each direction, i.e. determining the values of $N_x$, $N_y$ and $N_z$.

For action (v) the grid in which the plurality of heat exchange modules (10) are arranged is preferably made cubicle, as this will limit the size of the headers and thereby the overall size and weight of the indirect heat exchanger and thus the costs thereof.

For action (vi) the dimensions and shape of the first distribution header (101) and the first collection header (102) may be designed such that not more than a predetermined part of the total pressure drop over the indirect heat exchanger of the first fluid is caused by the first distribution header (101) and first collection header (102). Also, the dimensions and shape of the second distribution header (103) and the second collection header (104) are designed such that not more than $1/3^{rd}$ of the pressure drop of the second fluid is caused by the second distribution header (103) and second collection header (104).

According to a further aspect there is provided a method of operating an indirect heat exchanger as described above, wherein the flow rate of the first fluid flow, inlet temperature of the first fluid flow, inlet pressure of the first fluid flow, flow rate of the second fluid flow, inlet temperature of the second fluid flow, inlet pressure of the second fluid flow, are controlled such that the first and second fluid flow are laminar in the first and second fluid flow channels (11, 21).

A flow may be considered laminar if the Reynolds number of that flow is below a predetermined Reynolds number. The predetermined Reynolds number may for instance be 2300, 2000, 1200 or 900 depending on the design of the fluid flow channels, the dimensions of the fluid flow channels, material used and roughness thereof. For 3D printed fluid flow channels, especially fluid flow channels having a diameter less than 1 mm, flow will be laminar to a Reynolds number of typically 900.

According to an aspect there is provided a method of manufacturing an indirect heat exchanger as described above, wherein the method comprises manufacturing the plurality of heat exchange modules (10) with the use of 3D printing techniques or chemical etching techniques. The method may further comprises assembling the heat exchange modules (10) in a rectangular grid as defined above. Neighbouring heat exchange modules (10) may be positioned intermediate distances (dx, dy) with respect to each other, thereby creating the first manifolds (12) and second manifolds as defined above.

According to yet another aspect, the present disclosure provides a facility for the processing of liquefied natural gas, the facility comprising at least one indirect heat exchanger as described above.

According to an aspect, the present disclosure provides a facility for the processing of liquefied natural gas, the facility comprising at least one indirect heat exchanger, the indirect heat exchanger comprising: a first inlet for receiving a first fluid flow, a first outlet for discharging the first fluid flow, a second inlet for receiving a second fluid flow, a second outlet for discharging the second fluid flow, a plurality of heat exchange modules (10) arranged in a rectangular grid, the grid having a first direction, a second direction and a third direction, the heat exchange modules each comprising a first module face and a second module face being opposite to each other in the first direction, the heat exchange modules each comprising a third module face and a fourth module face being opposite to each other in the second direction, and the heat exchange modules (10) each comprising a plurality of first fluid flow channels (11) extending between the first module face and the second module face for accommodating the first fluid flow and a plurality of second fluid flow channels (21) extending between the third module face and the fourth module face for accommodating the second fluid flow, first manifolds (12) fluidly connecting the plurality of first fluid flow channels (11) of one of the heat exchange modules with the plurality of first fluid flow channels (11) of an adjacent heat exchange module (10) thereby forming one or more first fluid paths connecting the first inlet with the first outlet and running through two or more heat exchange modules (10), and second manifolds (22) fluidly connecting the plurality of second fluid flow channels (21) of one of the heat exchange modules with the plurality of second fluid flow channels (21) of an adjacent heat exchange module (10) thereby forming one or more second fluid paths connecting the second inlet with the second outlet and running through two or more heat exchange modules (10).

BRIEF DESCRIPTION OF THE DRAWINGS

The drawing figures depict one or more implementations in accordance with the present teachings, by way of example only, not by way of limitation. In the figures, like reference numerals refer to the same or similar elements.

DETAILED DESCRIPTION OF THE INVENTION

The term facility for processing liquefied natural gas as used herein may refer to, at least, a facility for liquefying natural gas and/or a facility for regasifying liquefied natural gas.

The term indirect heat exchanger is used in this text to refer to a heat exchanger in which heat transfer can take place between to flows without the flows being in direct contact with each other, i.e. the flows remain separated by one or more heat exchange surface. This contrary to a direct heat exchanger which involve heat transfer between two fluids/phases in the absence of a separating wall. In this text, instead of the term indirect heat exchanger, the term heat exchanger may be used as well.

An indirect heat exchanger is provided with an architecture that provides an improved balance between maximizing heat transfer per unit volume, minimizing pressure drop and is relatively easy and cost-efficient to produce. The architecture uses optimized heat exchange modules which are connected in a space efficient way. The advantage of the use of relatively small heat exchange modules is that depending on the design, the efficiency is higher because a large part of the flow is undeveloped (the heat transfer is higher before the thermal entrance length is reached). Also, by using relatively small fluid flow channels, i.e. having a small hydraulic diameter, an increased heat transfer area density and increased heat transfer coefficient are obtained.

The architecture allows the use of relatively short channels. The heat exchange modules comprise first and second fluid flow channels for the first and second fluid flows, whereby the first fluid flow channels substantially extend in a first direction and the second fluid flow channels substantially extend in a second direction, thereby allowing relatively simple distribution and collecting headers, with limited pressure drop. The architecture, moreover, allows connection of heat exchange modules in parallel or in series to match the required duty and pressure drop limitations and allows to design the outer dimensions of the indirect heat exchanger to meet specific requirements (such as a limited plot space).

It is noted that the heat exchange modules, including the first and second fluid flow channels may be produced with the use of 3D printing techniques or chemical etching techniques.

Figure 1A:
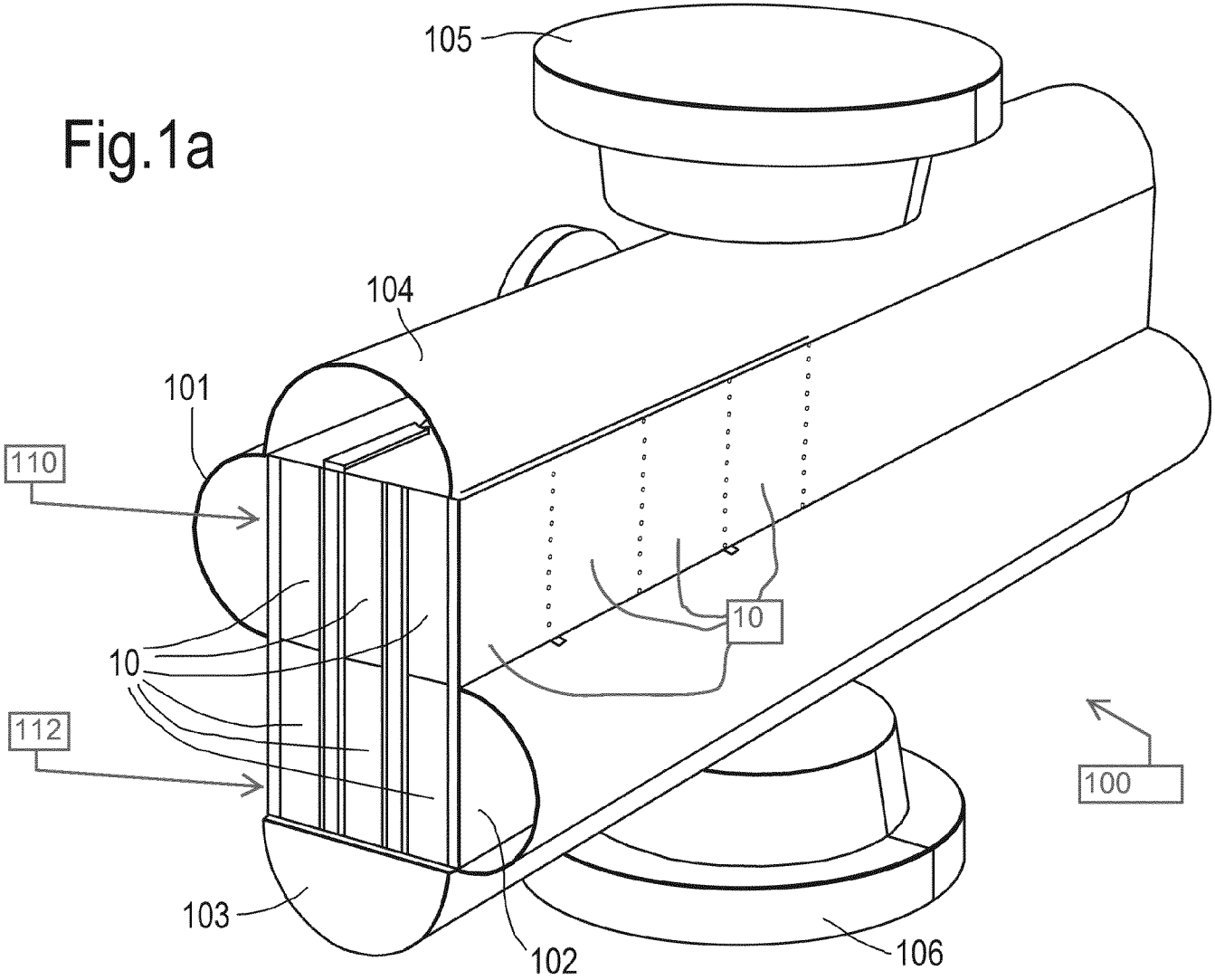
FIGS. 1*a*-1*d* provide a schematic illustration of the indirect heat exchanger and details thereof according to embodiments, FIGS. 2*a*-2*d* schematically depict different embodiments of fluidly connecting the heat exchange modules.

FIG. 1*a* schematically depicts an indirect heat exchanger unit 100 according to an embodiment. The heat exchanger unit 100 may have a first inlet comprising a first distribution header 101, a first outlet comprising a first collection header 102. The heat exchanger unit 100 hay have a second inlet comprising, for instance, a second distribution header 103 and a second outlet comprising a second collection header 104.

FIG. 1*a* schematically shows a plurality of heat exchange modules 10. The modules 10 are for instance arranged in a rectangular grid, being positioned at the center of the indirect heat exchanger unit 100. The heat exchange modules 10 as depicted in FIG. 1*a* are only shown schematically.

As shown, the heat exchange unit 100 may comprise multiple heat exchange modules 10. The embodiment shown in FIG. 1*a* comprises, for instance, in the order of two to five, for instance three heat exchange modules arranged side-by-side (x-direction). The heat exchange unit 100 may comprise a number of layers, for instance two or more layers 110, 112, of heat exchange modules on top of each other (z-direction). The heat exchange unit 100 may comprise a number of heat exchange modules 10 arranged adjacent in the length direction (y-direction), for instance in the range of four to ten, for instance about eight modules 10.

FIG. 1*a* further schematically shows optional first outlet flange connection 105 connected to the second collection header 104 and inlet flange connection 106 connected to the second distribution header 103. Although not shown in FIG. 1*a*, the first distribution header 101 and the first collection header 102 may likewise be provided with respective flange connections. The flange connections 105, 106 facilitate easy connection of process streams to the indirect heat exchanger unit 100.

Figure 1B:
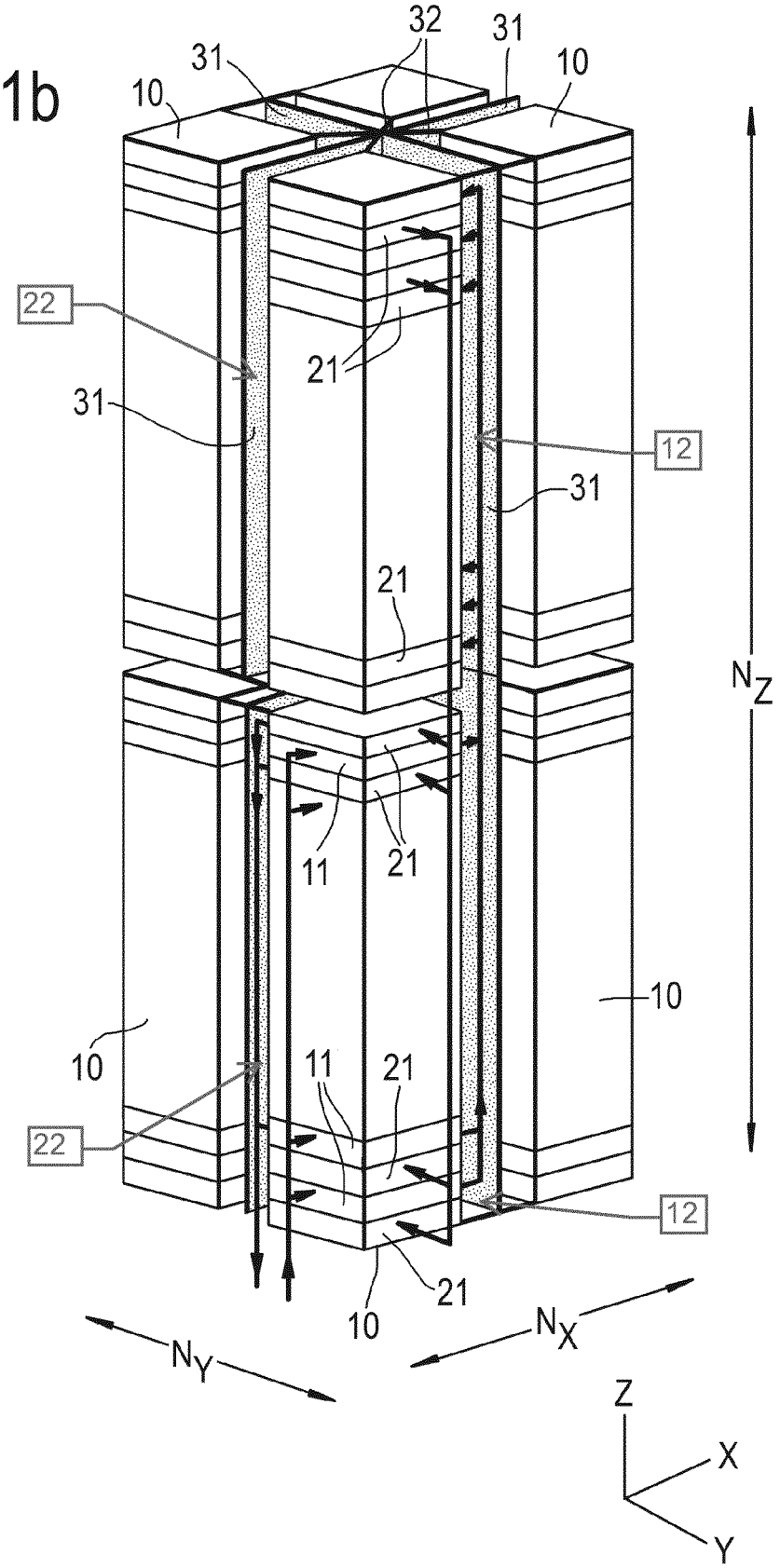

FIG. 1*b* schematically shows a possible arrangement of some (for instance eight) heat exchange modules 10 in more detail. The heat exchange modules 10 may be arranged in a rectangular grid, the grid having a first direction (x), a second direction (y) and a third direction (z).

FIG. 1*b* schematically shows first manifolds 12 fluidly connecting the first fluid flow channels 11 of one heat exchange module 10 with the first fluid flow channels 11 of an adjacent heat exchange module 10 thereby forming one or more first fluid paths connecting the first inlet with the first outlet and running through two or more heat exchange modules 10.

FIG. 1*b* schematically shows second manifolds 22 fluidly connecting the second fluid flow channels 21 of one heat exchange module 10 with the second fluid flow channels 21 of an adjacent heat exchange module 10 thereby forming one or more second fluid paths connecting the second inlet with the second outlet and running through two or more heat exchange modules 10.

FIG. 1*b* further shows division walls being positioned in the manifolds. Division walls 31 are provided to keep flow paths carrying the same fluid (first or second) separated. The division walls may be aligned with the grid. Diagonal division walls 32 are provided to keep flow paths carrying different fluids separated. Diagonal division walls 32 may be positioned diagonally with respect to the grid. Division walls 31 prevent fluid from flowing from one heat exchange module 10 to another diagonally adjacent heat exchange module. However, it is emphasized that such division walls 31 are optional and can be omitted, although the diagonal division walls 32 (seen in the third direction) are still needed to separate the first and second fluid flows. Such an embodiment is depicted in FIG. 1*d*.

Figure 1C:
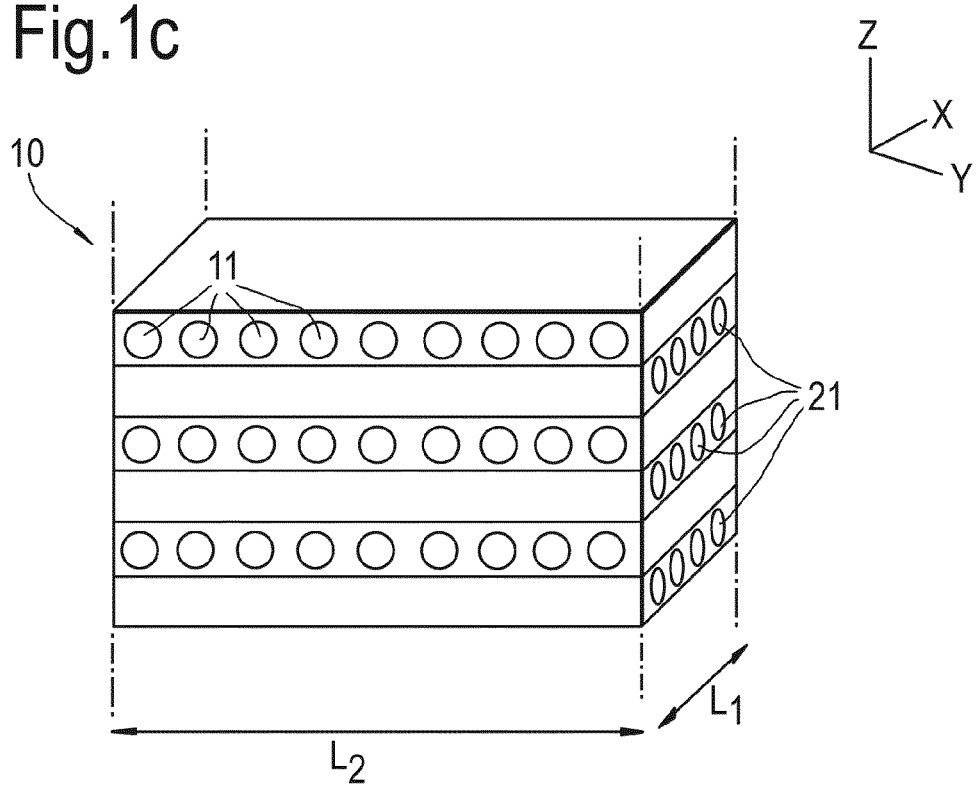
Figure 1D:
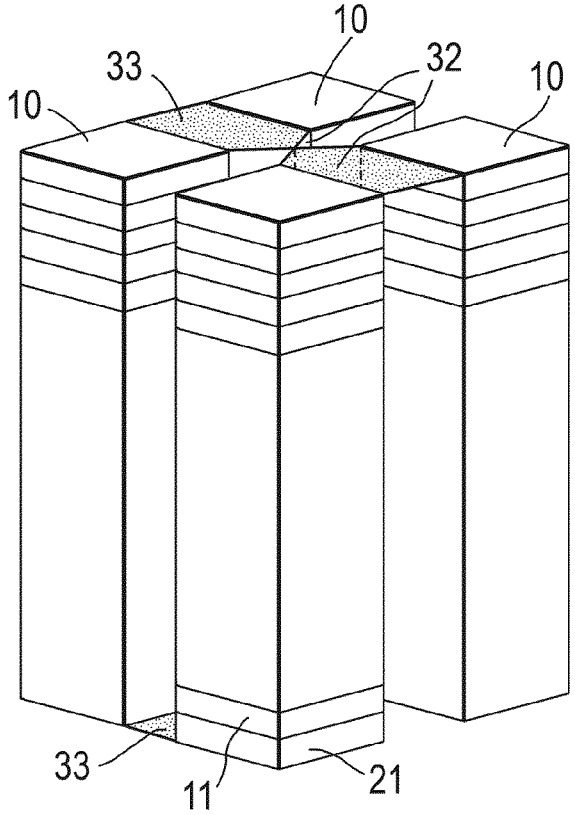

FIG. 1*d* further depicts guiding plates 33 (shown shaded) extending in the first and second direction provided to guide the first and second flow in the required (meandering) fluid paths through the subsequent heat exchange modules 10. These guiding plates 33 are not depicted in FIG. 1*b*, for reasons of clarity only.

As can be seen in FIG. 1*b*, the first and second manifolds 12, 22 extend in the third direction. As will be explained in more detail below, alternative embodiments are provided as well.

FIG. 1*b* further shows that each heat exchange module 10 comprises a plurality of first fluid flow channels 11 extending in the first direction for accommodating the first fluid flow and a plurality of second fluid flow channels 21 extending in the second direction for accommodating the second fluid flow. The first and second fluid flow channels are depicted as straight channels, but it will be understood that non-straight flow channels are encompassed as well, such as channels provided in a weaved structure. So, described more generally, the heat exchange modules 10 comprise a plurality of first fluid flow channels 11 extending between a first module face and a second module face for accommodating the first fluid flow, the first and second module faces being opposite to each other in the first direction and comprises a plurality of second fluid flow channels 21 extending between a third module face and a fourth module face for accommodating the second fluid flow, the third and fourth module faces being opposite to each other in the second direction. The first and second module faces may be parallel and equally sized and shaped. The third and fourth module faces may be parallel and equally sized and shaped.

The heat exchange module 10 comprises a number of alternatively stacked, in the third direction, first and second fluid channels.

According to an embodiment schematically depicted in FIG. 1*c*, it can be seen that the heat exchange module 10 may comprise a number of layers stacked in the third direction, each layer comprising a plurality of first and second fluid channels 11, 21.

According to an embodiment within a heat exchange module 10 the plurality of first fluid flow channels 11 and the plurality of second fluid flow channels 21 are stacked in the third direction.

The plurality of first fluid flow channels 11 and the plurality of second fluid flow channels 21 may be stacked alternatingly in the third direction, with one or more fluid flow channels being provided at the same level in the third direction. One or more first fluid flow channels 11 may be positioned next to each other (in the second direction) at the same level in the third direction. One or more second fluid flow channels 21 may be positioned next (in the first direction) to each other at the same level in the third direction.

For instance, the heat exchange module 10 may comprise a plurality of layers stacked in the third direction, the layers alternatingly comprising one or more first fluid flow channels 11 and one or more second fluid flow channels 21.

The heat exchange module 10 may comprise a number of layers, each layer comprising one or more first fluid flow channels or one or more second fluid flow channels. Each layer may only comprise first fluid flow channels or second fluid flow channels.

In case a layer comprises two or more (first or second) fluid flow channels, the fluid flow channels may be formed as channels, having any suitable cross-sectional shape, such as a circular, a semi-circular or elliptical cross-section. The first fluid flow channels may all be parallel to each other. The second fluid flow channels may all be parallel to each other. These channels may be formed by the use of 3D printing or chemical etching, allowing optimizing the size, shape and number of the heat exchange modules and the channels. Using such manufacturing techniques, there are few limitations to the geometry. The fluid flow channels may have a diameter of less than 1 mm, less than 0.5 mm or even less than 0.2 mm (200 micrometer (μm)).

The first and second fluid flow channels may be provided in a more complex morphology, like minimal surface based type morphologies, weaved structures, for instance in a plain weave structure. According to such an embodiment, the first and second fluid flow channels may be extending in the first and second direction respectively, but in addition also comprise variation in the third direction to obtain the weave structure. More generally, the heat exchange modules each comprise a first module face and a second module face being opposite to each other in the first direction, wherein the heat exchange modules 10 each comprise a plurality of first fluid flow channels 11 extending between the first module face and the second module face for accommodating the first fluid flow. In between the first and second module face, the first fluid flow channels may follow a straight path, but also any other suitable path. The first fluid flow channels may also split and/or combine with other first fluid flow channels.

Similarly, the heat exchange modules each comprise a third module face and a fourth module face being opposite to each other in the second direction, wherein the heat exchange modules 10 each comprise a plurality of second fluid flow channels 21 extending between the third module face and the fourth module face for accommodating the second fluid flow. In between the third and fourth module face, the second fluid flow channels may follow a straight path, but also any other suitable path. The second fluid flow channels may also split and/or combine with other second fluid flow channels.

According to an embodiment, the first fluid flow channels 11 have a first channel length $L_1$ in the first direction, the first channel length $L_1$ being smaller or equal to the thermal entrance length $L_{TL,1}$ of the first fluid in the first fluid flow channels for predetermined design operating parameters of the indirect heat exchanger 1.

According to an embodiment, the second fluid flow channels 21 have a second channel length $L_2$ in the second direction, the second channel length $L_2$ being smaller or equal to the thermal entrance length $L_{TL,2}$ of the second fluid in the second fluid flow channels for predetermined design operating parameters of the indirect heat exchanger 1.

The current indirect heat exchanger design makes it possible to design an indirect heat exchanger in which the heat exchange between the fluids occurs between first and second fluid flow channels that are dimensioned such that the fluid flows in the respective fluid flow channels are undeveloped over the entire length of the fluid flow channel or at least over most of the length of the fluid flow channel, preferably at least over 90%, 75% or 50% of the length of the fluid flow channel.

The thermal entrance length is the approximate length taken from the entrance of the fluid flow channel where thermal boundary layers are present. The thermal entrance length $L_t$ is the approximate longitudinal position along the fluid flow channel where the thermal boundary layers have just merged. Downstream of $L_t$, the temperature distribution across the channel has a fully developed profile. Said another way, the stream must travel a certain distance ($L_t$) before it is penetrated fully by the diffusion of heat from or to the wall.

One of ordinary skill in the art will understand how to compute the thermal entrance length. For instance, in the laminar flow regime, the thermal entrance length depends on the Reynolds (Re) and Prandtl (Pr) numbers and the characterizing width of the fluid flow channel (D, e.g. the diameter in case of a fluid flow channel having a circular cross-section). The thermal entrance length is 0.05 Re·Pr·D.

According to an embodiment, the first channel length $L_1$ is longer or shorter than the second channel length $L_2$.

The term longer is used to indicate that the first channel length $L_1$ is at least 10% longer than the second channel length $L_2$: $L_1>1.1*L_2$. The term shorter is used to indicate that the first channel length $L_1$ is at least 10% shorter than the second channel length $L_2$: $L_1<0.9*L_2$.

The first and second fluid flow channels are preferably straight channels (although may alternatively be provided in a weaved pattern). The first fluid flow channels may have a different length than the second fluid flow channels.

This feature allows to provide different channel lengths for the first and second fluid flow channels, to take into account the different fluid characteristics and operating conditions (such as flow rate) of the first and second fluid. It is recognized that optimizations can be reached by allowing rectangular heat exchange modules rather than square heat exchange modules (seen in the third direction), to take into account that the first and second fluid flows may have different thermal entrance lengths.

The first and second fluid flow channels preferably have a circular cross section. The first fluid flow channels may have a first diameter D1 that is larger or smaller than a second diameter D2 of the second fluid flow channels. The term longer is used to indicate that the first diameter $D_1$ is at least 10% longer than the second diameter $D_2$: $D_1>1.1*D_2$. The term shorter is used to indicate that the first diameter $D_1$ is at least 10% shorter than the second diameter $D_2$: $D_1<0.9*D_2$.

FIG. 1*b* further shows that gaps are provided between heat exchange modules 10 adjacent in the first and second direction in which the manifolds are positioned. These gaps create the first and second manifolds.

According to an embodiment there is provided an indirect heat exchanger wherein the heat exchange modules 10 adjacent in the first direction are positioned at an intermediate distance (dx) with respect to each other, thereby creating the first manifolds 12 and wherein heat exchange modules 10 adjacent in the second direction are positioned at an intermediate distance (dy) with respect to each other, thereby creating the second manifolds 22.

Different lay-outs of the plurality of first fluid flow channels 11 extending in the first direction and the plurality of second fluid flow channels 21 and consequently for the first and second manifolds are possible, as will be described in more detail below.

As indicated above, the currently proposed architecture provides freedom to design the overall lay-out and shape of the indirect heat exchanger. The first manifolds as well as the second manifolds may be used to fluidly connect first and second fluid flow channels of heat exchange modules 10 adjacent in the first, second or third directions.

Figure 2A:
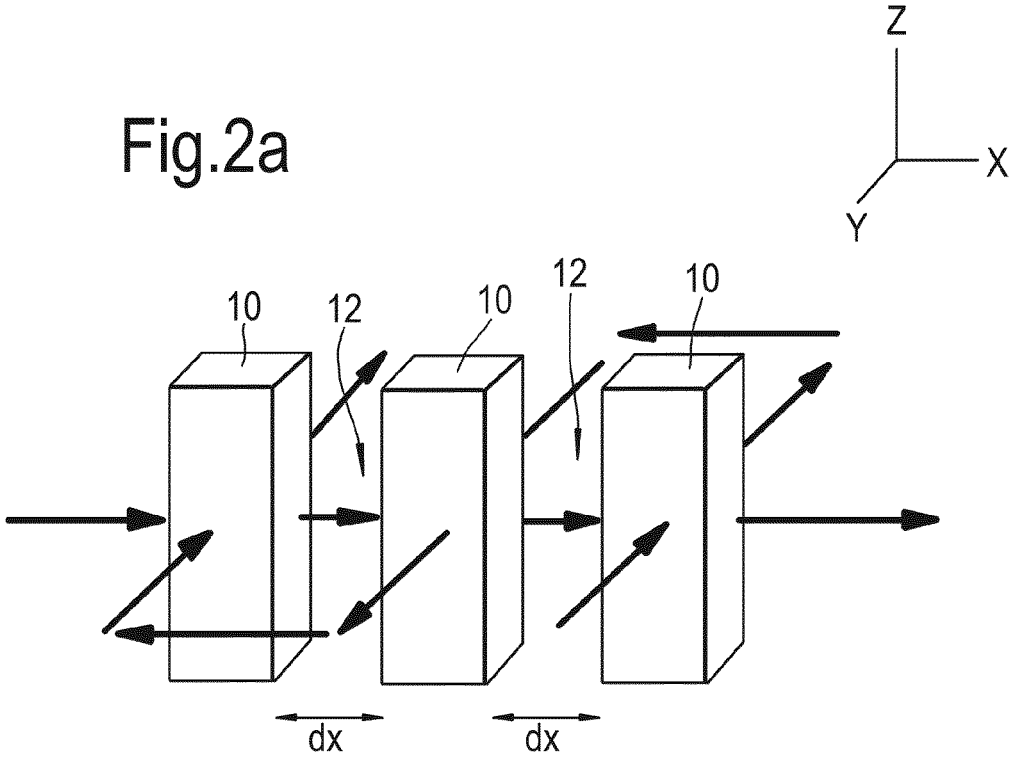

According to an embodiment schematically depicted in FIG. 2*a*, the first manifolds 12 fluidly connect two heat exchange modules 10 adjacent in the first direction, and the second manifolds 22 fluidly connect two heat exchange modules 10 adjacent in the first direction.

According to this embodiment, the first fluid flows through a number of heat exchange modules 10 positioned in series without any bends, while the second fluid flow meanders through the number of heat exchange modules taking bends when transferring from second fluid flow channels 21 to second manifolds 22 and back. This embodiment has the advantage that the first fluid flow does not make sharp bends when flowing from one to the next heat exchange module.

The heat exchange modules 10 adjacent in the first direction may be positioned at an intermediate distance dx with respect to each other to create the manifold, i.e. an 'open area' in between adjacent heat exchange modules, allowing the first fluid flow to form a uniform velocity and a substantially flat temperature profile. This ensures that when the first fluid flow enters the next heat exchange module 10, again advantage is taken from having an undeveloped flow over the entire length, or at least over a substantial part, of the fluid flow channel Also, this facilitates simulation of the indirect heat exchanger as all heat exchange modules experience similar inflow conditions.

On the one hand, the value for dx is preferably as small as possible to limit the size of the indirect heat exchanger, while on the other hand the value for dx is preferably large enough to allow for the above mentioned advantages. Therefore, according to an embodiment, the distance dx is at most 70% of the length of the first fluid flow channel, preferably at least 50% of the length of the first fluid flow channel According to an embodiment, dx>0.

An example of such an embodiment is schematically depicted in FIG. 2*a* and will be described in more detail below.

The first manifolds have a length in the first direction equal to the distance dx and is further dimensioned in the second and third direction to match the dimensions of the heat exchange module in the second and third directions respectively.

The second manifolds extend in the first direction along the adjacent heat exchange modules it fluidly connects and the distance dx and is further dimensioned in the first and third direction to match the dimensions of the adjacent heat exchange modules in the first and third direction respectively.

Subsequent second manifolds are positioned on alternating sides of the heat exchange modules in the second direction and are off-set with respect to each other in the first direction with a distance substantial equal to the dimension of a heat exchange module in the first direction plus dx, thereby creating meandering second fluid paths.

The first and second fluid flows are in crossflow within a heat exchange module 10 and counter flow on the level of the entire indirect heat exchanger.

Figure 2B:
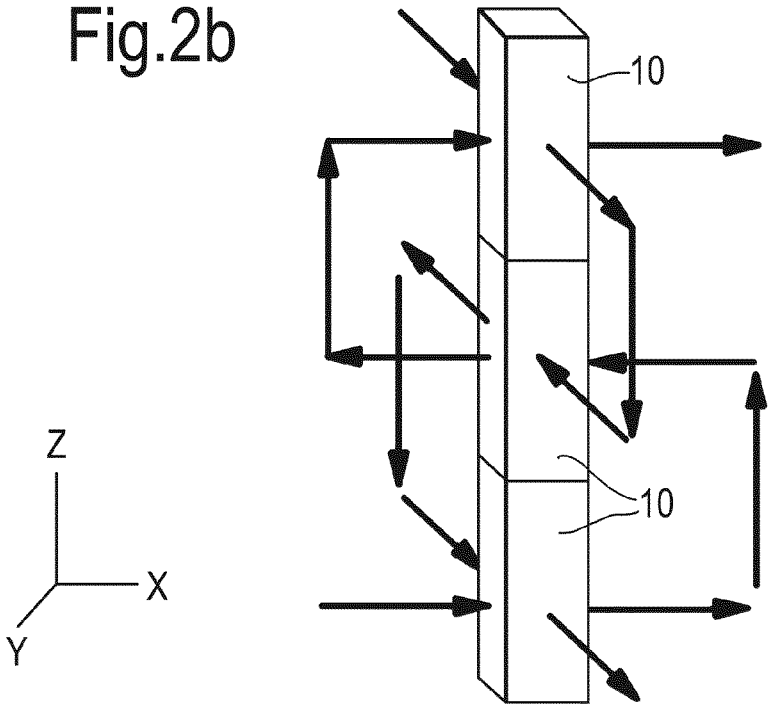

According to an embodiment, schematically depicted in FIG. 2*b*, the first manifolds fluidly connect two heat exchange modules adjacent in the third direction, and the second manifolds fluidly connect two heat exchange modules adjacent in the third direction.

An example of such an embodiment is schematically depicted in FIG. 2*b* and will be described in more detail below. Such an embodiment may in particular be advantageous in situations with limited plot space available, such as for instance on off-shore facilities (including fixed platforms, semi-submersibles platforms, gravity based platforms, tension leg platforms and floating production vessels). Examples of off-shore facilities are a floating liquid natural gas facility (FLNG vessel), floating production, storage and offloading facility (FPSO) and floating storage and regasification unit (FSRU).

According to this embodiment, the first fluid meanders through a number of heat exchange modules 10 and also the second fluid flow meanders through a number of heat exchange modules, both the first and second flows taking bends when transferring from fluid flow channels to manifolds and back.

The first manifolds extend in the first direction over a distance dx/2, extend in the second direction to match the dimension of the adjacent heat exchange modules in the second direction and extend in the third direction along two adjacent heat exchange modules.

The second manifolds extend in the first direction to match the dimension of the adjacent heat exchange modules in the first direction, extend in the second direction over a distance dy/2, and extend in the third direction along two adjacent heat exchange modules.

If the heat exchange modules are positioned at an intermediate distance dz in the third direction, which may not necessarily be the case, the first and second manifolds also cover this intermediate distance dz in the third direction.

The described embodiment is makes it possible to position the heat exchange modules in series without increasing the required plot space. This may in particular be advantageous in situations wherein less plot space is available, such as on ships or barges, for instance on a FLNG-vessel (floating liquid natural gas) or LNG regasifying vessel (LNG: liquid natural gas).

The first and second fluid flows may be in counter-flow or in parallel flow.

According to an embodiment the indirect heat exchanger 1 comprises a plurality of first manifolds fluidly connecting heat exchange modules adjacent in the first direction and a plurality of first manifolds fluidly connecting two heat exchange modules adjacent in the second or third direction.

Figure 2C:
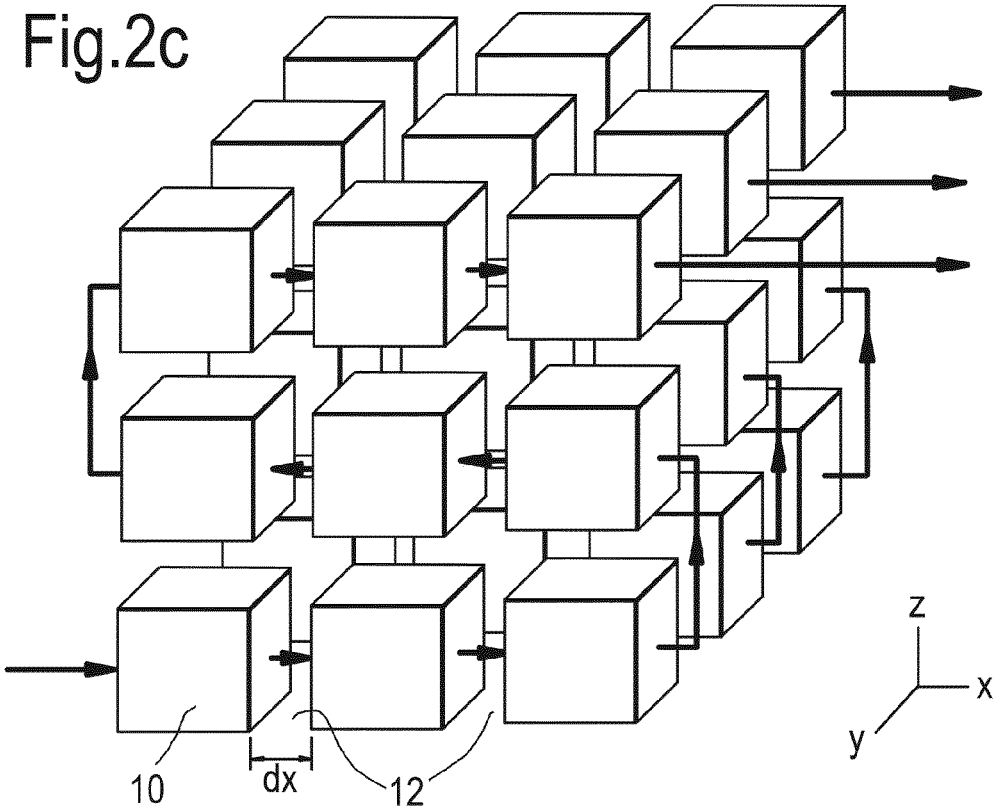

An example of such an embodiment is schematically depicted in FIG. 2*c*.

According to such an embodiment, the one or more first fluid paths connecting the first inlet with the first outlet may run through a first group of heat exchange modules 10 positioned in series in the first direction, followed by a second group of heat exchange modules 10 positioned in series in the first direction, followed by a third group of heat exchange modules 10 positioned in series in the first direction, wherein the first and second group being adjacent to each other in the second or third direction and are in fluid communication by means of a first manifold connecting two heat exchange modules adjacent in the second or third direction and the second and third group being adjacent to each other in the second or third direction and being in fluid communication by means of a first manifold connecting two heat exchange modules adjacent in the second or third direction.

It will be understood that any suitable amount of further groups of heat exchange modules 10 may be added to the respective one or more first fluid paths.

According to such an embodiment an increased freedom of designing the overall shape of the indirect heat exchanger is obtained, wherein the length of the indirect heat exchanger in the first direction as well as the height of the indirect heat exchanger in the third direction can be adjusted. The pressure drop experienced by the first flow can be kept relatively low, as the number of bends (manifolds extending in the third direction) is limited with respect to the number of heat exchange modules.

Figure 2D:
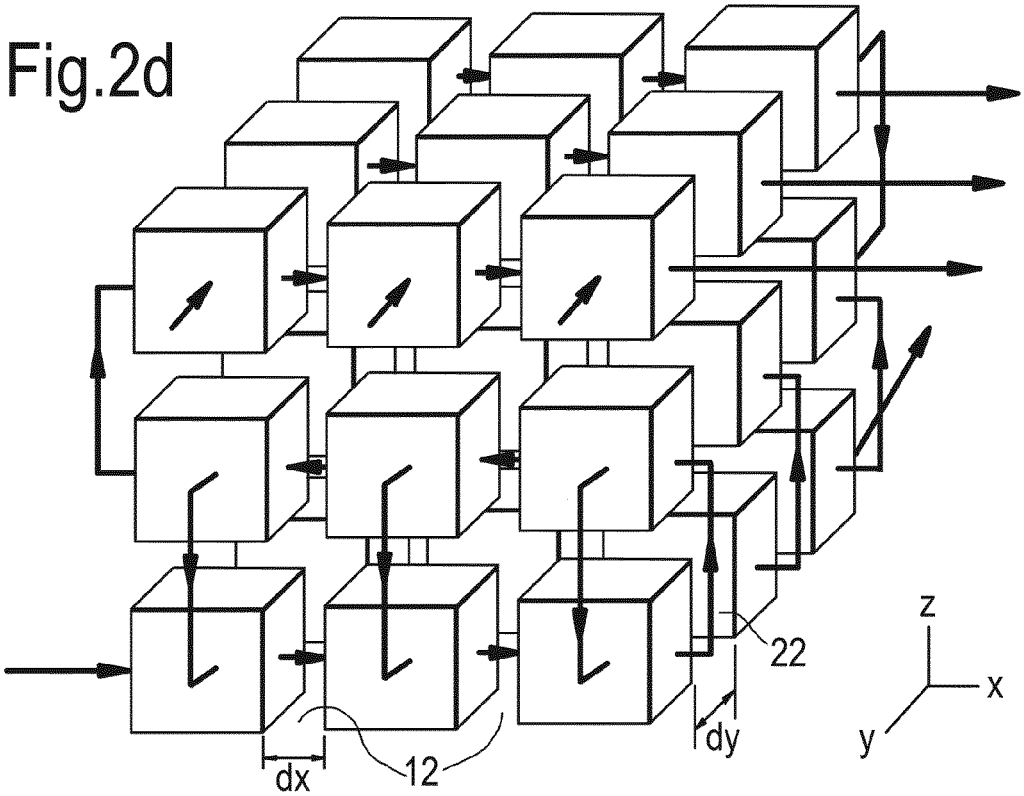

According to an embodiment, schematically depicted in FIG. 2*d*, the indirect heat exchanger 1 comprises a plurality of second manifolds fluidly connecting two heat exchange modules adjacent in the second direction and a plurality of second manifolds fluidly connecting two heat exchange modules adjacent in the first or third direction.

An example of such an embodiment is schematically depicted in FIG. 2*d*.

According to such an embodiment, the one or more second fluid paths connecting the second inlet with the second outlet may run through a first group of heat exchange modules 10 positioned in series in the second direction, followed by a second group of heat exchange modules 10 positioned in series in the second direction, followed by a third group of heat exchange modules 10 positioned in series in the second direction, wherein the first and second group being adjacent to each other in the first or third direction and are in fluid communication by means of a second manifold connecting two heat exchange modules adjacent in the first or third direction and the second and third group being adjacent to each other in the first or third direction and being in fluid communication by means of a second manifold connecting two heat exchange modules adjacent in the first or third direction.

It will be understood that any suitable amount of further groups of heat exchange modules 10 may be added to the respective one or more second fluid paths.

According to such an embodiment an increased freedom of designing the overall shape of the indirect heat exchanger is obtained, wherein the length of the indirect heat exchanger in the second direction as well as the height of the indirect heat exchanger in the third direction can be adjusted. The pressure drop experienced by the second flow can be kept relatively low, as the number of bends (manifolds extending in the third direction) is limited with respect to the number of heat exchange modules.

According to an embodiment the first inlet comprises a first distribution header 101, the first outlet comprises a first collection header 102, the second inlet comprises a second distribution header 103 and the second outlet comprises a second collection header 104. This is schematically depicted in FIG. 1*a*, already discussed above.

The headers may have any suitable shape and may for instance be formed as a cap covering at least part of a face of the rectangular grid. The headers may comprise internals or may be provided with a specific shape to optimize distribution of the fluid.

As indicated above, the respective distribution and collecting headers may each be associated with a single face of the rectangular grid. Different design options are possible.

The distribution and collecting headers may be associated with faces of the rectangular grid allowing the fluid flow to directly enter the heat exchange modules. This may be the case in embodiments wherein the first distribution header is associated with a first face of the rectangular grid facing in the first direction, the first collecting header is associated with a second face of the rectangular grid facing in the opposite direction of the first face, the second distribution header is associated with a third face of the rectangular grid facing in the second direction and the second collecting header is associated with a fourth face of the rectangular grid facing in the opposite direction of the third face.

However, alternative embodiments are conceivable, in which the respective distribution and collecting headers are associated with respective faces of the rectangular grid facing in a different direction than the direction of the respective fluid flow through the heat exchange modules. For instance, the first distribution header may be associated with (part of) a first face of the rectangular grid facing in the second direction, the first collecting header may be associated with (part of) a second face of the rectangular grid facing in the opposite direction of the first face, the second distribution header may be associated with (part of) a third face of the rectangular grid facing in the third direction and the second collecting header may be associated with (part of) a fourth face of the rectangular grid facing in the opposite direction of the third face.

In such embodiments, one or more first and second fluid distribution channels may be provided to fluidly connect the respective first and second distribution headers with the first and second fluid flow channels 11, 21 of heat exchange modules and one or more first and second fluid collecting channels may be provided to fluidly connect the respective first and second collecting headers with the first and second fluid flow channels 11, 21 of heat exchange modules. Preferably, such first and second fluid distribution channels are provided in between two (rows of) adjacent heat exchange modules to provide both (rows of) adjacent heat exchange modules with first and second fluid respectively. Likewise, such first and second fluid collection channels are provided in between two (rows of) adjacent heat exchange modules to receive first and second fluid respectively from both (rows of) adjacent heat exchange modules.

According to a further embodiment a first set of first fluid paths and a first set of second fluid paths is associated with a first set of heat exchange modules 10 and a second set of first fluid paths and a second set of second fluid paths is associated with a second set of heat exchanger modules 10. The first and second sets of heat exchange modules 10 do not overlap. The first sets of first and second fluid paths are exclusively associated with the first set of heat exchange modules and the second sets of first and second fluid paths are exclusively associated with the second set of heat exchange modules. Additional sets of heat exchange modules may be provided having additional exclusively associated first and second fluid paths. This way different sets of first and second fluid paths are provided parallel to each. The first and second fluid distribution channels and first and second fluid collecting channels are provided to distribute the first and second fluids over the different sets of fluid paths.

The present application is directed to relatively compact heat exchangers. Said heat exchangers can be advantageously applied in a facility for the processing of liquefied natural gas. As heat exchangers typically occupy a significant area of such facility, and as area and required plot space directly influence the required capital expenditure, the availability of more compact heat exchangers may enable a significant saving in CAPEX. CAPEX in turn is a key factor in the economic viability of such facility. However, the design of the heat exchangers of the present disclosure also enables more efficient heat transfer. And more efficient heat transfer in turn reduces the required amount of heat exchangers and consequently further reduces the required area, plot space and associated costs.

For more compact heat exchangers the drive is to use smaller channel diameters because this allows to place more surface area in the same volume. This will reduce requirement for material and associated costs. By applying smaller channel diameters, it becomes beneficial to design the heat exchanger to operate in the laminar flow region. In the laminar flow region there is a better heat transfer and an improved pressure drop ratio. Benefits are for instance particularly beneficial in a ratio for small channel diameters (small herein being, for instance, a diameter of each flow channel 11, 21 in the order of 1 mm or smaller). When a heat exchanger is designed to operate in the laminar flow region, it becomes favorable to keep the channel length within the entrance length as this region has a better heat transfer coefficient than fully developed flow.

In order to make use of the entrance length, the flow has to brought in a channel and recollected again several times when traveling through the heat exchanger. This difficulty is aggrevated for industrial scale heat exchangers, such as for use in a method for processing liquefied natural gas, as a relatively large number of subsequent heat exchanger modules is required to be able to provide sufficient temperature reduction. Above, an embodiment is described comprising at least 8 modules. The phrase large number herein may however refer to a number exceeding eight modules, for instance in the range of about 20 to 100 interconnected heat exchanger modules or more.

Traditional manufacturing techniques (like milling, welding of tubes, etc.) are unsuitable to make a suitable recollection area to interconnect modules, as this introduces complexities during fabrication. Consequently, there is currently no industrial scale heat exchanger with recollection areas to effectively use the thermal entrance length. As an example, printed circuit heat exchangers (PCHE) are currently the most compact build heat exchangers used in the oil and gas industry, yet PCHEs have continuous channels between the inlet and outlet of the heat exchanger.

Figure 3:
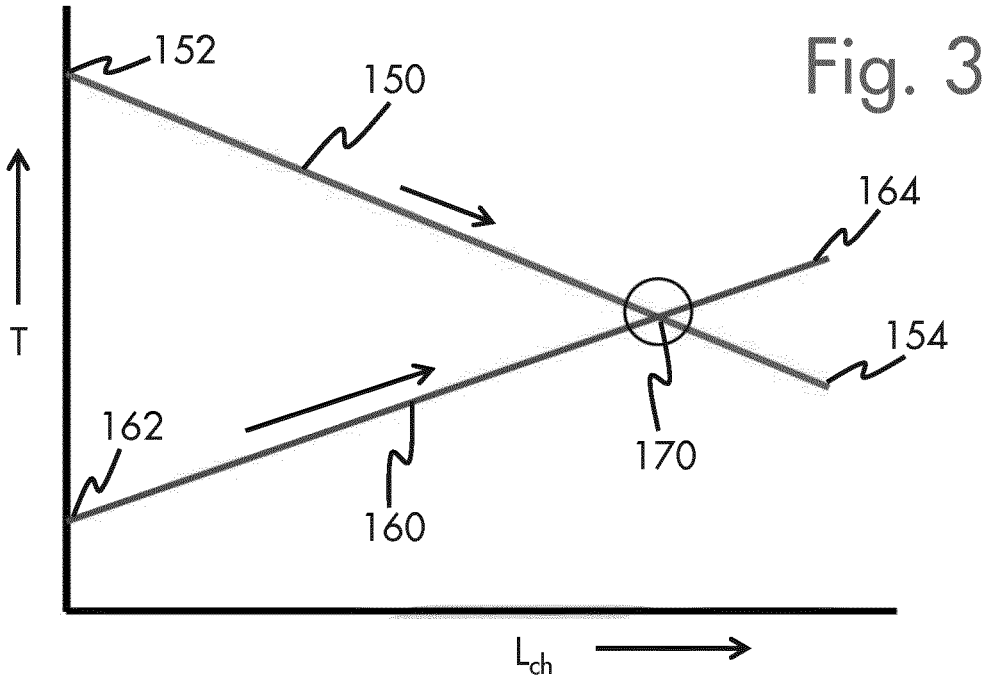
FIG. 3 shows an exemplary graph of temperature versus channel length of a prior art heat exchanger.

FIG. 3 shows a diagram indicating temperature T on the vertical axis versus channel length $L_{ch}$ on the horizontal axis. For a conventional heat exchanger having continuous channels, a feed stream temperature profile 150 in a first channel may drop, for instance continuously, from a warm end 152 to a cold end 154. A continuous second channel, arranged perpendicular with respect to the first channel, may hold a refrigerant. A refrigerant temperature profile 160 of the refrigerant flowing in the second channel may consequently increase, for instance continuously, from a cold end 162 to a warm end 164. The temperature differential at the entrance of both channels (i.e. between the temperature at warm end 152 and cold end 162) should be sufficient to avoid temperatures in both channels to cross over, indicated by cross-over point 170.

Figure 4:
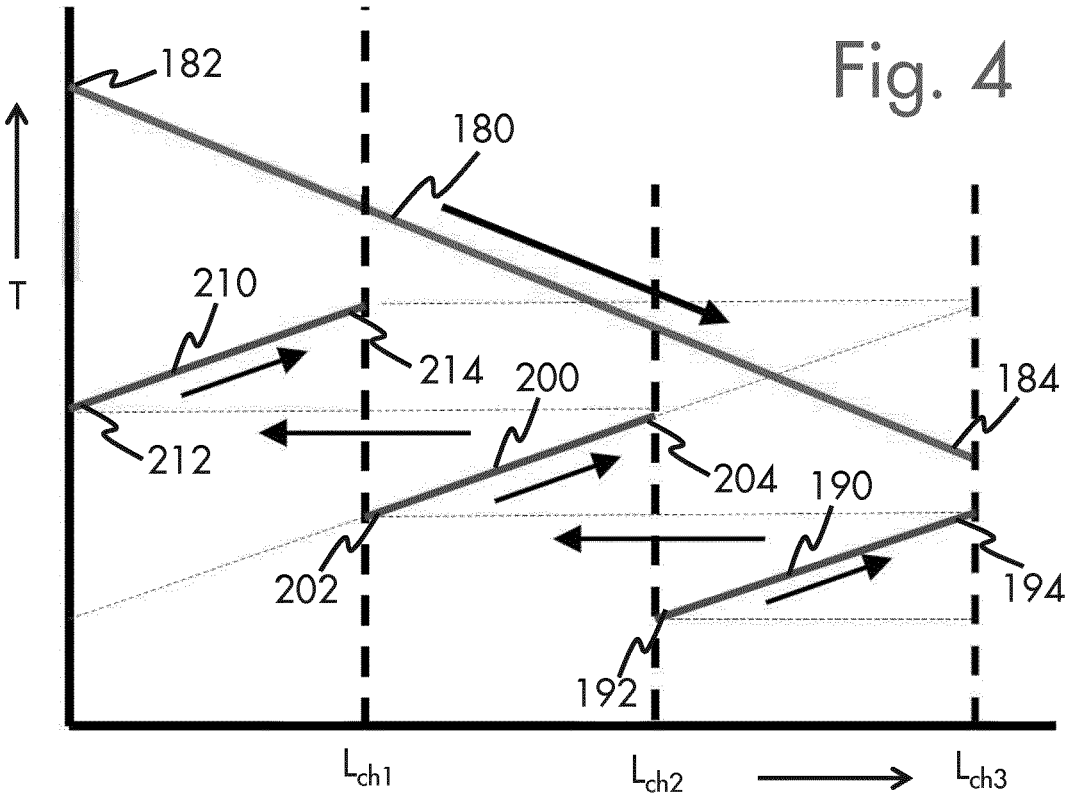
FIG. 4 shows an exemplary graph of temperature versus channel length of subsequent channels of an embodiment of a heat exchanger module according to the present disclosure.

The modular setup of the heat exchanger unit of the present disclosure allows to avoid temperature cross over, as indicated in FIG. 4. FIG. 4 as an example graphically shows the temperature T versus channel length L for, for instance, three channels $L_{ch1}$, $L_{ch2}$, $L_{ch3}$ in, for instance, three subsequent modules 10. Herein, the feed stream temperature profile 180 drops from a warm end 182 to a cold end 184, through first channel $L_{ch1}$ to second channel $L_{ch2}$ to third channel $L_{ch3}$. Refrigerant flows in counter flow through third channel $L_{ch3}$ to second channel $L_{ch2}$ to first channel $L_{ch1}$. This results in subsequent refrigerant temperature profiles 190, 200 and 210 steadily increasing from cold end 192 to warm end 194 of the third or last channel, to cold end 202 and on to warm end 204 of the second channel, to cold end 212 and on to warm end 214 of the first channel The heat exchanger unit 100 of the present disclosure allows to extend the temperature profile of FIG. 4 to industrial scale by adding a virtually unlimited number of subsequent modules.

The heat exchangers disclosed in U.S. Pat. No. 3,986,549 and US20130125545 are intended for small scale applications, in homes or vehicles respectively, and are unsuitable to scale up in an economically viable way. For instance, the heat exchanger disclosed in US20130125545A1 (discussed in the introduction) has a configuration wherein fluid is mixed at intermediate steps to achieve a uniform temperature in the downstream heat exchanging channels. This leads to more uniform heating or cooling of the working fluid, in order to achieve a counter-current flow orientation.

The heat exchanger of the present application comprises manifolds which not only allow to achieve a counter current flow orientation for each subsequent module, the manifolds also mix the flow in order to start flow in each respective module with uniform velocity profile. This allows to effectively use of the benefits of the thermal entrance length. In addition, the heat exchanger of the present application provides both a mass reduction and a volume reduction with respect to the currently smallest heat exchangers used for oil and gas, printed circuit heat exchangers (PCHE).

The heat exchanger of the present disclosure can be scaled up to allow application at industrial scale. For instance, the heat exchange unit 100 can be scaled to replace water cooled heat exchangers in a facility for processing liquefied natural gas. In such application, the heat exchanger of the present disclosure may be incorporated in a process to cool a natural gas stream from a processing temperature in the order of 60 degree C. to a water loop temperature in the order of 0 to 10 degree C.

In a practical embodiment, the heat exchange unit 100 may comprise in the order of 50 interconnected heat exchange modules 10 (such as shown in FIG. 1*a*). The flanged connections of inlets and outlets of the heat exchange unit allow to connect multiple heat exchange units 100 either in parallel or in series, as required.

In a practical embodiment, the modules 10 may have a length and/or width (x and y direction respectively) in the order of 10 to 50 cm, for instance about 20 cm. The height of the modules 10 (z direction) may be in the order of 20 to 100 cm, for instance about 50 cm. The heat exchange unit 100 (FIG. 1*a*) may be in the order of about 1.25 m wide, 2 m long, and 1.5 m high. The assembly of interconnected heat exchange modules 10, inside the heat exchange unit 100, may have a width in the order of 75 cm, a height in the order of 1 m and span substantially the full length of the unit 100.

Thus, the heat exchange module 100 is suitable for industrial scale application, for instance for processing liquefied natural gas. A single unit 100 can be sized sufficiently large to handle high volume throughput. Yet, the unit 100 can be sized to be transported to and from an industrial site by concentional means, such as by truck, crane and/or vessel. Multiple units 100 can be included in parallel and/or in series, to increase the cooling capacity.

For application in a facility for liquefying natural gas, flow rates of refrigerant and process stream (typically pretreated natural gas) may be in the order of 0.5 to 20 m/s. The heat exchange modules of the present disclosure are suitable for use with a range of refrigerants, including water, methane, ethane, propane and nitrogen, or mixed refrigerant (MR). MR typically comprises a mixture of hydrocarbons, such as methane, ethane, and/or propane. The MR may include nitrogen.

The present disclosure is not limited to the embodiments as described above and the appended claims. Many modifications are conceivable and features of respective embodiments may be combined.

The following examples of certain aspects of some embodiments are given to facilitate a better understanding of the present invention. In no way should these examples be read to limit, or define, the scope of the invention.

What is claimed is:

1. A method of using an indirect heat exchanger comprising:

a first inlet for receiving a first fluid flow;

a first outlet for discharging the first fluid flow, a second inlet for receiving a second fluid flow, a second outlet for discharging the second fluid flow, a first heat exchange module positioned adjacent to a second heat exchange module in a first direction;

a third heat exchange module positioned adjacent to the first heat exchange module or the second heat exchange module in a second direction;

a fourth heat exchange module positioned adjacent to the first heat exchange module or the second heat exchange module or the third heat exchange module in a third direction; wherein the first direction, the second direction, and the third direction are perpendicular with respect to each other; the heat exchange modules each comprising a first module face and a second module face being opposite to each other in the first direction, the heat exchange modules each comprising a third module face and a fourth module face being opposite to each other in the second direction, and the heat exchange modules each comprising a plurality of first fluid flow channels extending between the first module face and the second module face for accommodating the first fluid flow and a plurality of second fluid flow channels extending between the third module face and the fourth module face for accommodating the second fluid flow, first manifolds fluidly connecting the plurality of first fluid flow channels of one of the heat exchange modules with the plurality of first fluid flow channels of an adjacent heat exchange module thereby forming one or more first fluid paths connecting the first inlet with the first outlet and running through two or more heat exchange modules, and second manifolds fluidly connecting the plurality of second fluid flow channels of one of the heat exchange modules with the plurality of second fluid flow channels of an adjacent heat exchange module thereby forming one or more second fluid paths connecting the second inlet with the second outlet and running through two or more heat exchange modules;

wherein the first fluid flow channels having a first channel length, $L_1$ in the first direction, the first channel length $L_1$ being smaller or equal to the thermal entrance length $L_{TL1}$ of the first fluid in the first fluid flow channels for predetermined design operating parameters of the indirect heat exchanger, the second fluid flow channels having a second channel length $L_2$ in the second direction, the second channel length $L_2$ being smaller or equal to thermal entrance length $L_{TL2}$ of the second fluid in the second fluid flow channels for predetermined design operating parameters of the indirect heat exchanger, the method comprising the steps of:

bringing the first fluid flow in one of the first fluid flow channels and recollecting the first fluid flow in one of the first manifolds several times when traveling through the indirect heat exchanger;

bringing the second fluid flow in one of the second fluid flow channels and recollecting the second fluid flow in one of the second manifolds several times when traveling through the indirect heat exchanger, and the first manifolds collecting the first fluid from one heat exchange module of the plurality of heat exchange modules, conveying at least part of the first fluid to an adjacent heat exchange module, and feeding the first fluid to the first fluid flow channels of the second heat exchange module, wherein at least one of the first manifolds and the second manifolds fluidly connecting at least two of the heat exchange modules adjacent one another in the third direction.

2. The method of claim 1, wherein the first channel length $L_1$ is longer or shorter than the second channel length $L_2$.

3. The method of claim 1, wherein the first heat exchange module and the second heat exchange module being adjacent in the first direction, wherein the first and adjacent heat exchange modules are positioned at an intermediate distance with respect to each other, thereby creating the first manifolds and wherein heat exchange modules adjacent in the second direction are positioned at an intermediate distance (dy) with respect to each other, thereby creating the second manifolds.

4. The method of claim 1, wherein within the heat exchange modules the plurality of first fluid flow channels and the plurality of second fluid flow channels are stacked in the third direction.

5. The method of claim 1, wherein the first manifolds fluidly connect the first and second heat exchange modules adjacent in the first direction, and the second manifolds fluidly connect the first and second heat exchange modules adjacent in the first direction.

6. The method of claim 1, wherein the first manifolds fluidly connecting the heat exchange modules adjacent in the first direction and the first manifolds fluidly connecting two of the heat exchange modules adjacent in the second or third direction.

7. The method of claim 1, wherein the second manifolds fluidly connecting two of the heat exchange modules adjacent in the second direction and the second manifolds fluidly connecting two of the heat exchange modules adjacent in the first or third direction.

8. The method of claim 1, wherein the first inlet comprises a first distribution header, the first outlet comprises a first collection header, the second inlet comprises a second distribution header and the second outlet comprises a second collection header.

9. The method of claim 1, wherein a first set of the first fluid paths and a first set of the second fluid paths being associated with a first set of the heat exchange modules and a second set of the first fluid paths and a second set of the second fluid paths being associated with a second set of the heat exchange modules.

10. The method of claim 1, comprising the step of using the indirect heat exchanger for the processing of liquefied natural gas or liquefying natural gas.

11. The method of claim 1, wherein the first fluid flow channels and/or the second fluid flow channels having a diameter of less than 1 mm.

12. The method of claim 1, wherein the second manifolds collecting the second fluid from a heat exchange module, conveying at least part of the second fluid to an adjacent heal exchange module and feeding the second fluid to the second fluid flow channels of the adjacent heat exchange module.

13. The method of claim 1, wherein the indirect heat exchanger comprising at least 8 heat exchanger modules.

14. The method of claim 10, wherein the first fluid being a refrigerant, the second fluid being a process stream, and flow rates of the refrigerant and the process stream being in the order of 0.5 to 20 m/s.

15. The method of claim 1, further comprising the step of controlling a flow rate of the first fluid flow, inlet temperature of the first fluid flow, inlet pressure of the first fluid flow, flow rate of the second fluid flow, inlet temperature of the second fluid flow, inlet pressure of the second fluid flow, such that the first fluid flow and the second fluid flow are laminar in the first fluid flow channels and the second fluid flow channels.

16. The method of claim 15, wherein the first fluid flow in the first fluid flow channels and the second fluid flow in the second fluid flow channels having a Reynolds number up to 900.

17. The method of claim 1, wherein each module comprises a length and a width, each in a range from 10 cm and up to 50 cm, and a height in a range from 20 cm and up to 100 cm.

18. A method of designing a facility comprising an indirect heat exchanger comprising:

a first inlet for receiving a first fluid flow, a first outlet for discharging the first fluid flow, a second inlet for receiving a second fluid flow, a second outlet for discharging the second fluid flow, a first heat exchange module positioned adjacent to a second heat exchange module in a first direction;

a third heat exchange module positioned adjacent to the first heat exchange module or the second heat exchange module in a second direction;

a fourth heat exchange module positioned adjacent to the first heat exchange module or the second heat exchange module or the third heat exchange module in a third direction; wherein the first direction, the second direction, and the third direction are perpendicular with respect to each other; the heat exchange modules each comprising a first module face and a second module face being opposite to each other in the first direction, the heat exchange modules each comprising a third module face and a fourth module face being opposite to each other in the second direction, and the heat exchange modules each comprising a plurality of first fluid flow channels extending between the first module face and the second module face for accommodating the first fluid flow and a plurality of second fluid flow channels extending between the third module face and the fourth module face for accommodating the second fluid flow, first manifolds fluidly connecting the plurality of first fluid flow channels of one of the heat exchange modules with the plurality of first fluid flow channels of an adjacent heat exchange module thereby forming one or more first fluid paths connecting the first inlet with the first outlet and running through two or more heat exchange modules, and second manifolds fluidly connecting the plurality of second fluid flow channels of one of the heat exchange modules with the plurality of second fluid flow channels of an adjacent heat exchange module thereby forming one or more second fluid paths connecting the second inlet with the second outlet and running through two or more heat exchange modules;

the first fluid flow channels having a first channel length $L_1$ in the first direction, the first channel length $L_1$ being smaller or equal to the thermal entrance length $L_{TL1}$ of the first fluid in the first fluid flow channels for predetermined design operating parameters of the indirect heat exchanger, the second fluid flow channels having a second channel length $L_2$ in the second direction, the second channel length $L_2$ being smaller or equal to thermal entrance length $L_{TL2}$ of the second fluid in the second fluid flow channels for predetermined design operating parameters of the indirect heat exchanger, the first fluid flow channels being adapted to being the first fluid flow in one of the first fluid flow channels and recollect the first fluid flow in one of the first manifolds several times when traveling through the heat exchanger;

the second fluid flow channels being adapted to bring the second fluid flow in one of the second fluid flow channels and recollect the second fluid flow in one of the second manifolds several times when traveling through the heat exchanger, and the first manifolds being adapted to collect the first fluid from one heat exchange module of the plurality of heat exchange modules, convey at least part of the first fluid to another adjacent heat exchange module of the plurality of heat exchange modules, and feed the first fluid to the first fluid flow channels of this adjacent heat exchange module;

at least one of the first manifolds and the second manifolds fluidly connecting at least two of the heat exchange modules adjacent one another in the third direction;

wherein the method of designing comprises:

determining design operating parameters of the indirect heat exchanger, the design operating parameters comprising one or more of: flow rate of the first fluid flow, inlet temperature of the first fluid flow, outlet temperature of the first fluid flow, inlet pressure of the first fluid flow, outlet pressure of the first fluid flow, physical properties of the first fluid, flow rate of the second fluid flow, inlet temperature of the second fluid flow, outlet temperature of the second fluid flow, inlet pressure of the second fluid flow, outlet pressure of the second fluid flow, duty of the indirect heat exchanger, physical properties of the second fluid, wherein the method further comprises, based on the design operating parameters, i) determining the amount of heat exchange modules to be comprised in the first and second fluid paths, ii) determining the amount of first and second fluid flow channels per heat exchange module, as well as the cross-sectional dimensions of the first and second fluid flow channels, iii) determining the lengths of the first and second fluid flow channels, iv) determining the dimensions of the first and second manifolds, v) determining a lay-out of the rectangular grid, vi) determining the dimensions of a first distribution header, a first collection header, a second distribution and a second collection header.

19. The method of claim 18, wherein the physical properties of the first and second fluid include at least one of mass density, viscosity, specific heat capacity and thermal conductivity.

20. A method of manufacturing an indirect heat exchanger comprising:

a first inlet for receiving a first fluid flow, a first outlet for discharging the first fluid flow, second inlet for receiving a second fluid flow, a second outlet for discharging the second fluid flow, a first heat exchange module positioned adjacent to a second heat exchange module in a first direction;

a third heat exchange module positioned adjacent to the first heat exchange module or the second heat exchange module in a second direction;

a fourth heat exchange module positioned adjacent to the first heat exchange module or the second heat exchange module or the third heat exchange module in a third direction; wherein the first direction, the second direction, and the third direction are perpendicular with respect to each other; the heat exchange modules each comprising a first module face and a second module face being opposite to each other in the first direction, the heat exchange modules each comprising a third module face and a fourth module face being opposite to each other in the second direction, and the heat exchange modules each comprising a plurality of first fluid flow channels extending between the first module face and the second module face for accommodating the first fluid flow and a plurality of second fluid flow channels extending between the third module face and the fourth module face for accommodating the second fluid flow, first manifolds fluidly connecting the plurality of first fluid flow channels of one of the heat exchange modules with the plurality of first fluid flow channels of an adjacent heat exchange module thereby forming one or more first fluid paths connecting the first inlet with the first outlet and running through two or more heat exchange modules, and second manifolds fluidly connecting the plurality of second fluid flow channels of one of the heat exchange modules with the plurality of second fluid flow channels of an adjacent heat exchange module thereby forming one or more second fluid paths connecting the second inlet with the second outlet and running through two or more heat exchange modules, the first fluid flow channels having a first channel length $L_1$ in the first direction, the first channel length $L_1$ being smaller or equal to the thermal entrance length $L_{TL1}$ of the first fluid in the first fluid flow channels for predetermined design operating parameters of the indirect heat exchange, the second fluid flow channels having a second channel length $L_2$ in the second direction, the second channel length $L_2$ being smaller or equal to the thermal entrance length $L_{TL2}$ of the second fluid in the second fluid flow channels for predetermined design operating parameters of the indirect heat exchange, the first fluid flow channels being adapted to bring the first fluid flow in one of the first fluid flow channels and recollect the first fluid flow in one of the first manifolds several times when traveling through the heat exchanger;

the second fluid flow channels being adapted to bring the second fluid flow in one of the second fluid flow channels and recollect the second fluid flow in one of the second manifolds several times when traveling through the heat exchanger, and the first manifolds being adapted to collect the first fluid from one heat exchange module of the plurality of heat exchange modules, convey at least part of the first fluid to an adjacent heat exchange module of the plurality of heat exchange modules, and feed the first fluid to and adjacent heat exchange module of the plurality of heat exchange modules, and feed the first fluid to the first fluid flow channels of the adjacent heat exchange module, at least one of the first manifolds and the second manifolds fluidly connecting at least two of the heat exchange modules adjacent one another in the third direction;

wherein the method comprises manufacturing the plurality of heat exchange modules with the use of 3D printing techniques or chemical etching techniques.

21. A facility for the processing of liquefied natural gas, the facility comprising at least one indirect heat exchanger comprising:

a first inlet for receiving a first fluid flow, a first outlet for discharging the first fluid flow, a second inlet for receiving a second fluid flow, a second outlet for discharging the second fluid flow, a first heat exchange module positioned adjacent to a second heat exchange module in a first direction;

a third heat exchange module positioned adjacent to the first heat exchange module or the second heat exchange module in a second direction;

a fourth heat exchange module positioned adjacent to the first heat exchange module or the second heat exchange module or the third heat exchange module in a third direction; wherein the first direction, the second direction, and the third direction are perpendicular with respect to each other; the heat exchange modules each comprising a first module face and a second module face being opposite to each other in the first direction, the heat exchange modules each comprising a third module face and a fourth module face being opposite to each other in the second direction, and the heat exchange modules each comprising a plurality of first fluid flow channels extending between the first module face and the second module face for accommodating the first fluid flow and a plurality of second fluid flow channels extending between the third module face and the fourth module face for accommodating the second fluid flow, first manifolds fluidly connecting the plurality of first fluid flow channels of one of the heat exchange modules with the plurality of first fluid flow channels of an adjacent heat exchange module thereby forming one or more first fluid paths connecting the first inlet with the first outlet and running through two or more heat exchange modules, and second manifolds fluidly connecting the plurality of second fluid flow channels of one of the heat exchange modules with the plurality of second fluid flow channels of an adjacent heat exchange module thereby forming one or more second fluid paths connecting the second inlet with the second outlet and running through two or more heat exchange modules;

the first fluid flow channels having a first channel length $L_1$ in the first direction, the first channel length $L_1$ being smaller or equal to the thermal entrance length $L_{TL1}$ of the first fluid in the first fluid flow channels for predetermined design operating parameters of the indirect heat exchanger, the second fluid flow channels having a second channel length $L_2$ in the second direction, the second channel length $L_2$ being smaller or equal to the thermal entrance length $L_{TL2}$ of the second fluid in the second fluid flow channels for predetermined design operating parameters of the indirect heat exchanger, the first fluid flow channels being adapted to bring the first fluid flow in one of the first fluid flow channels and recollect the first fluid flow in one of the first manifolds several times when traveling through the heat exchanger;

the second fluid flow channels being adapted to bring the second fluid flow in one of the second fluid flow channels and recollect the second fluid flow in one of the first manifolds several times when traveling through the heat exchanger, and the first manifolds being adapted to collect the first fluid from one heat exchange module of the plurality of heat exchange modules, convey at least part of the first fluid to an adjacent heat exchange module of the plurality of heat exchange modules, and feed the first fluid to the first fluid flow channels of the adjacent heat exchange module;

wherein at least one of the first manifolds and the second manifolds fluidly connecting at least two of the heat exchange modules adjacent one another in the third direction.

22. The facility of claim 21, wherein the second manifolds being adapted to collect the second fluid from a heat exchange module, convey at least part of the second fluid to an adjacent heat exchange module and feed the second fluid to the second fluid flow channels of the adjacent heat exchange module.

23. The facility of claim 22, wherein the first fluid flow channels and/or the second fluid flow channels having a diameter of less than 1 mm.

* * * * *